United States Patent [19]

Wixson et al.

[11] 4,019,567

[45] Apr. 26, 1977

[54] LENS HOLDER

[75] Inventors: Donald F. Wixson, Wellsville; George K. Ostrander, Angelica, both of N.Y.

[73] Assignee: The Air Preheater Company, Inc., Wellsville, N.Y.

[22] Filed: Mar. 24, 1976

[21] Appl. No.: 670,011

[52] U.S. Cl. ..... 165/5; 165/11

[51] Int. Cl.[2] ..... F28D 19/04

[58] Field of Search ..... 165/5, 11

[56] References Cited

UNITED STATES PATENTS 3,730,259 5/1973 Wixson et al. ..... 165/5

3,861,458 1/1975 Ostrander et al. ..... 165/5

FOREIGN PATENTS OR APPLICATIONS 1,126,466 9/1968 United Kingdom ..... 165/5

*Primary Examiner*—C. J. Husar
*Assistant Examiner*—Sheldon Richter
*Attorney, Agent, or Firm*—Wayne H. Lang

[57] ABSTRACT

A holder for apparatus that is positioned in an air preheater to detect an increase in infra-red ray emission therefrom indicating a temperature rise that precedes conditions conducive to a fire in the air preheater.

3 Claims, 4 Drawing Figures

LENS HOLDER

BACKGROUND OF THE INVENTION

1. Field of the Invention

In regenerative air preheaters a mass of heat absorbent material commonly comprised of packed element plates forming a heat transfer matrix is positioned in a hot gas passageway to absorb heat from the hot gases passing therethrough. After the plates become heated by the hot gas they are suspended in a cool air passageway where they give up their absorbed heat to the cool air flowing therethrough.

As the hot exhaust gases are directed through the heat exchange apparatus, fly ash and unburned products of combustion carried by the exhaust gas are deposited on the surface of the packed element plates. These deposits continue to be deposited and to build up on the surfaces of the element plates until the flow passageways therethrough are blocked and all fluid flow through the heat exchanger is substantially stopped. Heat is then generated in the element itself until the deposits begin to glow and cause a "hot spot" that if not detected and promptly cooled will rapidly increase in size and temperature until the metal of the heat exchanger will itself ignite and cause a catastrophic fire.

2. Description of Prior Art

Recent developments in the use of infra-red ray detection apparatus to disclose the existence of "hot spots" in heat exchange apparatus in the manner disclosed by U.S. Pat. Nos. 3,730,259 of 1973, and 3,861,458 of 1975, have been successful in fulfilling their stated objective of signalling a potential fire or "hot spot" well in advance of the occurrence of a damaging fire.

In actual use, however, it has been found that mounting a typical infra-red detector including a lens therefor in an air preheater simultaneously subjects the detector and the lens to a constant stream of corrosive gases and particulate matter. Any viewing means exposed to such an atmosphere quickly becomes clouded, it fails to rapidly detect a change of infra-red ray emission, and it results in a loss of viewing efficiency. Therefore, it has been determined that any response of such apparatus to a variation in infra-red rays being emitted by a "hot spot" is directly dependent upon the cleanliness of the lens and the detection device.

SUMMARY OF THE INVENTION

This invention therefore relates to a detector of infra-red rays emanating from the heat absorbent matrix of a rotary regenerative heat exchange apparatus, and the principle objective thereof is to provide a holder for an infra-red detection lens that may be selectively moved between a "detecting" position in a dirty gas stream and a "cleaning" position in a clean air stream.

DESCRIPTION OF THE PREFERRED EMBODIMENT

Figure 1:
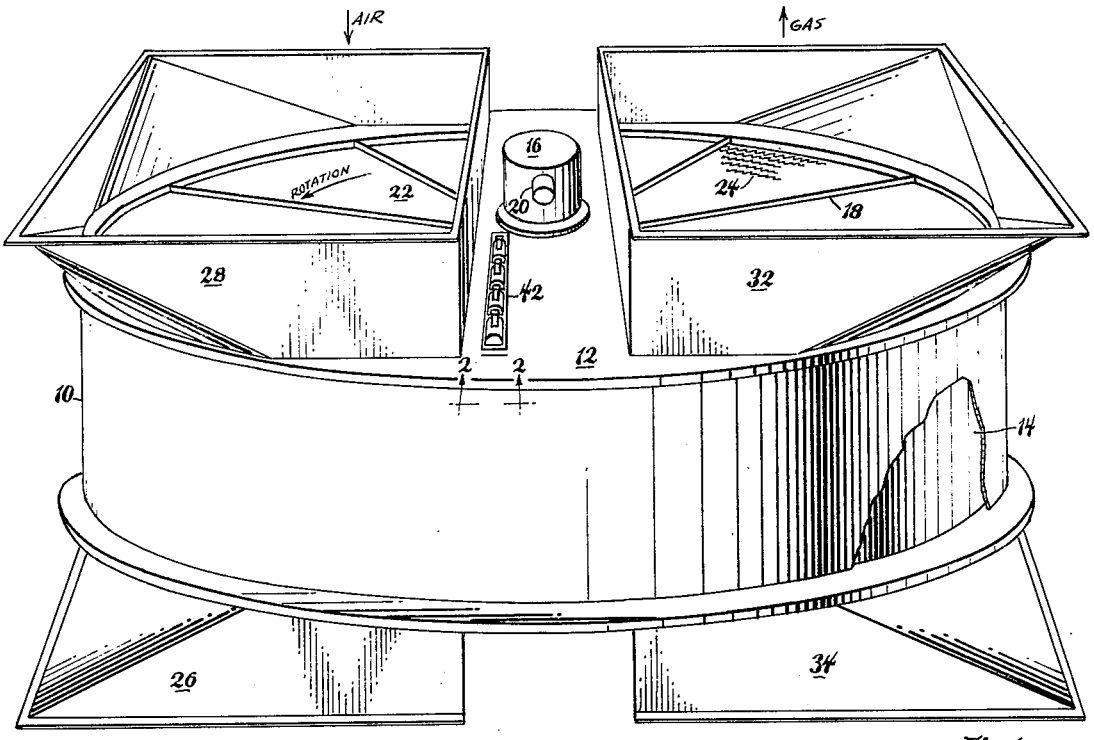
FIG. 1 is a perspective view of an air preheater including the present invention.
Figure 2:
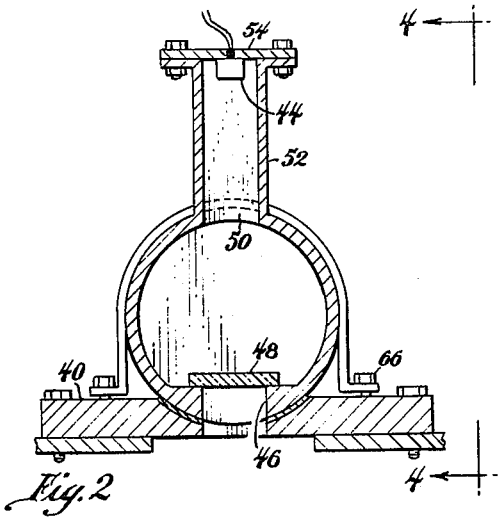
FIG. 2 is a cross section of the viewing device as seen from line 2—2 of FIG. 1.
Figure 4:
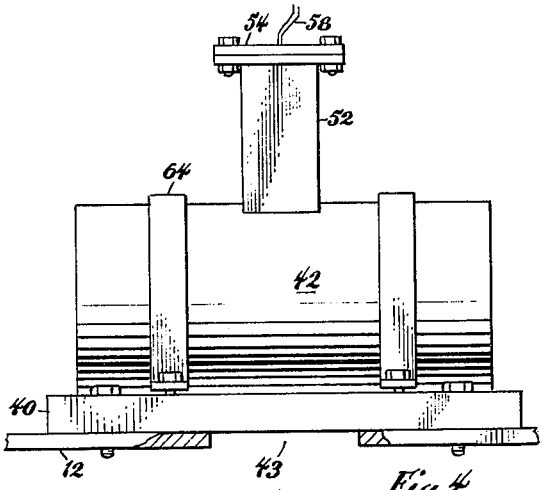
FIG. 4 is a side elevation of the device shown in FIG. 2.
Figure 3:
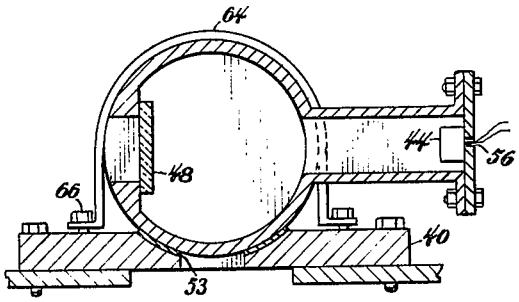
FIG. 3 is an end view of the device of FIG. 2 when rotated 90°.

In the drawings a rotary regenerative heat exchanger comprises a cylindrical casing 10 including end plates 12 at opposite ends thereof that enclose a rotor formed of a rotor sheel 14 connected to a central rotor post 16 by diaphragms or partitions 18 that produce a series of sector-shaped compartments 22 therebetween. The compartments are adapted to contain a mass of heat absorbent material in the form of plates 24 arranged in closely adjacent layers having passageways therebetween that permit the flow of fluids therethrough. The fluids include a fluid to be heated having an inlet duct 28 connected to the housing 10 and exhausting through an outlet 26. Similarly, a heating fluid flows oppositely to an inlet 34 and is exhausted through an outlet 32. The plates 24 thus absorb heat from the hot gases passing from inlet 28 to outlet 26, and they in turn give up their absorbed heat to a cooler fluid to be heated that flows from inlet 34 to outlet 32. After passing over the heated elements and absorbing fluid therefrom, the then heated fluid is directed to a boiler furnace or other place of use.

During start-up of a furnace or other apparatus producing hot combustion gas, incomplete combustion in the burners thereof may cause particles of fuel and unburned products of combustion to become entrained in the gas exhausting from the furnace and in turn be deposited upon the heat absorbent material of the heat exchanger. These deposits continuously build up and may in a short time block or at least partially slow the flow of fluid over the heat absorbent material. At the same time, the temperature of the deposits and the heat absorbent material adjacent thereto will rapidly rise because the material is not being bathed by a stream of cooling air. As temperatures reach 700° F to 750° F, the process becomes exothermic and heat is generated in the deposits to a point where an active fire occurs and the heat exchanger is severely damaged, if not destroyed.

Inasmuch as potentially damaging fires in heat exchange equipment originate as harmless "hot spots" whose temperature is only a little over that of the adjacent heat absorbent element, this invention is directed to apparatus that will detect the occurrence of such "hot spots" before they can develop into damaging fires, and it provides an arrangement for cleaning an infra-red detector whereby such a detector may at all times be maintained at near optimum operating efficiency.

In accordance with this invention the end plate 12 adjacent the inlet duct carrying the clean fluid to be heated is provided with a series of radially spaced cylindrical elements 42, each of which includes an infra-red ray detector 44 that is adapted to signal a predetermined increase in the intensity of infra-red rays received thereby and activate suitable alarm and/or relief equipment.

Each cylindrical element 42 is seated upon a plate 40 that covers an opening 43 in the end plate 12, and is itself provided with a lens opening 46. The lens opening 46 is adapted to receive an infra-red ray transmitting lens 48 that is firmly received thereto by suitable holding means not here shown.

The element 42 includes a second opening 50 diametrically opposite opening 46 and having a neck 52 in an enclosing relationship that terminates in a closure 54 sercured thereto. The closure includes an opening 56 through which the leads 58 from the detector 44 are directed, whereby infra-red rays traversing lens 48 are focused upon the detector 44 to actuate the detector and produce a suitable electrical response that is conveyed outward through wires 58. In a conventional manner the intensity of the infra-red ray emission, the rate of change thereof, or the departure from the norm may be programmed to produce a suitable response that will actuate an alarm and/or one of various corrective measures.

Each cylindrical element 42 has a circumferential outer surface that is held against a curved surface in plate 40 by a bandtype yoke 64 at opposite ends thereof. The yoke 64 is held snugly against the plate 40 by lugs 66 at opposite ends thereof that may be progressively screwed into plate 40 to produce an adjusting feature to maintain a constant degree of tightness on the yoke. In addition, a packing 53 is adapted to surround the openings 43–46 to conform to any irregularity and preclude fluid leakage between the members 40 and 42.

In operation, actuation of motor 20 rotates the rotor 14 about its axis and the heat absorbent material 24 is progressively moved into contact with the heating fluid. Each housing element 52 is normally arranged to position the lens 48 directly over opening 43 whereby infra-red rays being emitted by the element 24 will traverse lens 48 and pass directly to the detector 44. As the lens 48 becomes clouded with particulate deposits from within the air preheater, the light transmission effectiveness of the lens rapidly diminishes. Accordingly, the entire element 42 is manually rotated 90°, to close the opening 43 with the side of element 42, and simultaneously place the clouded lens in a position where it may be manually cleaned by an outside attendant.

While the invention has been described with reference to the accompanying drawing, it is readily understood by those skilled in the art that such invention permits various types of modification within the scope of the appended claims.

We claim:

1. A heat exchanger having a housing wall including spaced inlet and outlet ducts for a heating fluid and for a fluid to be heated, a matrix of heat absorbent material carried in said chamber, means for subjecting said matrix to the heating fluid and to the fluid to be heated, an opening in the housing of the heat exchanger axially spaced from said matrix and arranged to receive infra-red rays radiating therefrom, a cylindrical lens housing for an infra-red ray detector lying laterally adjacent the opening in said heat exchanger housing and having an opening in the peripheral wall thereof that coincides with the opening in the heat exchanger housing, an infra-red ray detector in the lens housing lying opposite the opening therein to receive the infra-red rays emitted from said matrix, a lens covering the opening in said lens housing, and yoke means encircling the cylindrical lens housing holding said housing laterally adjacent the heat exchanger housing whereby said lens housing may be rotated about its axis to selectively align the opening in the heat exchanger housing and the opening in the lens housing.

2. A heat exchanger as defined in claim 1 including means for rotating the matrix about its axis in said housing whereby said matrix is alternately aligned with the heating fluid and the fluid to be heated.

3. A heat exchanger as defined in claim 2 having sealing means lying intermediate the openings in the heat exchanger housing and the inlet housing to preclude fluid flow therebetween.

* * * * *